US012575683B2

(12) United States Patent
Leng

(10) Patent No.: US 12,575,683 B2
(45) Date of Patent: Mar. 17, 2026

(54) COVER, ELASTIC PAD AND FURNITURE

(71) Applicant: NEW-TEC INTEGRATION (XIAMEN) CO., LTD., Xiamen (CN)

(72) Inventor: Luhao Leng, Xiamen (CN)

(73) Assignee: NEW-TEC INTEGRATION (XIAMEN) CO., LTD., Xiamen (CN)

( * ) Notice: Subject to any disclaimer, the term of this patent is extended or adjusted under 35 U.S.C. 154(b) by 135 days.

(21) Appl. No.: 18/402,536

(22) Filed: Jan. 2, 2024

(65) Prior Publication Data

US 2024/0215733 A1 Jul. 4, 2024

(30) Foreign Application Priority Data

Jan. 4, 2023 (CN) ..... 202310010316.8

(51) Int. Cl.
*A47C 27/00* (2006.01)
*A47C 27/07* (2006.01)

(52) U.S. Cl.
CPC ..... *A47C 27/002* (2013.01); *A47C 27/07* (2013.01)

(58) Field of Classification Search
CPC . A47C 23/002; A47C 23/0438; A47C 27/063; A47C 31/105; A47C 23/0431; A47C 23/05; A47C 27/064; A47C 27/065; A47C 27/06; A47C 27/07; A47C 27/15; A47C 27/056; A47C 27/14; A47C 27/053; A47C 27/0456; A47C 23/30; A47C 23/057; A47C 23/005; A47C 27/20; A47C 17/86; A47C 27/001; A47C 27/05; A47C 27/006; A47C 23/00; A47C 27/04; A47C 27/045; A47C 27/061; A47C 27/062; F16F 1/08; F16F 1/12; F16F 3/04; F16F 3/047; F16F 3/061
See application file for complete search history.

(56) References Cited

U.S. PATENT DOCUMENTS

2015/0026893 A1* 1/2015 Garrett ..... A47C 27/064 5/691
2016/0157625 A1 6/2016 Schneider et al.
2023/0200553 A1 6/2023 Leng

FOREIGN PATENT DOCUMENTS

CA 3155053 A1 * 4/2021 ..... A47C 27/07
CN 115191779 A 10/2022
CN 115191780 A 10/2022
CN 115191782 A 10/2022
(Continued)

OTHER PUBLICATIONS

Extended European Search Report for European Application No. 24150328.3; Date of Mailing: Jun. 12, 2024; 9 pages.

*Primary Examiner* — Madison Emanski
(74) *Attorney, Agent, or Firm* — Perkins Coie LLP

(57) ABSTRACT

A cover for an elastic pad and furniture has at least one inner core layer comprising an elastic material layer, an outer wrapping cover removably wrapping the at least one inner core layer, and stop hems folded downwards from peripheral edges of the cover, forming an inner space configured to receive and shield a pad layer of the elastic pad. Only the outer wrapper need be removed for cleaning. The stop hems extend about the peripheral edges of the cover to form the inner space for receiving and shielding the pad layer of the elastic pad when the elastic pad is assembled. Assembly of the elastic pad is made more convenient and storage space required for the elastic pad is reduced.

27 Claims, 13 Drawing Sheets

(56) References Cited

FOREIGN PATENT DOCUMENTS

| | | | |
|---|---|---|---|
| CN | 115191783 | A | 10/2022 |
| CN | 115191785 | A | 10/2022 |
| JP | 3217749 | U | 8/2018 |

* cited by examiner

COVER, ELASTIC PAD AND FURNITURE

TECHNICAL FIELD

The present disclosure relates to the field of elastic pads, and in particular, to a cover for covering an elastic pad, an elastic pad and furniture.

BACKGROUND

Furniture such as beddings and sofa beds are essentials in the people's daily life. Most of the existing beddings and sofa beds are provided with elastic pads. Such elastic pads have a certain resilience, which can provide an elastic support to a certain extent when a person is lying on the beddings and the sofa beds. As such, an elastic pad is more comfortable than a hard pad.

Existing elastic pads are usually integral, non-detachable and encapsulated pads formed by a holistic bottom layer, a spring layer, a sponge overlay and enclosed side coverings and a top covering. That is, the spring layer is disposed on the holistic bottom layer, the sponge overlay is disposed on the spring layer, and the enclosed side coverings and the top covering wrap around the sponge overlay and the bottom layer to form an elastic pad with an internal closed space.

However, this type of elastic pads generally exhibits poor performance in comfort in practice. Additionally, they may be expensive, and also have poor stability in actual use, providing less comfort. Further, these elastic pads are inconvenient in transportation and occupy large spaces during the storage, and may not be easy to clean.

SUMMARY

To address at least some problems existing in the prior art, one of the objectives of the present disclosure is to improve convenience in assembling and cleaning an elastic pad while reducing an occupied space for storage of the elastic pad.

In order to achieve the above objective, in the first aspect, the present disclosure provides a cover for an elastic pad, comprising: at least one inner core layer comprising an elastic material layer; an outer wrapping cover removably wrapping the at least one inner core layer; and stop hems folded downwards from peripheral edges of the cover along a thickness direction of the elastic pad and extending a predetermined distance, thereby forming an inner space configured to receive and shield layers of the elastic pad.

In the technical solution according to the present application, since the at least one inner core layer of the cover includes an elastic material layer, it can efficiently improve the elastic support performance of the cover. Additionally, since the outer wrapping cover removably wraps the at least one inner core layer, it is only required to remove and clean the outer wrapping cover when cleaning is to be performed. Moreover, the stop hems extend about the peripheral edges of the cover to form the inner space for receiving and shielding the layers of the elastic pad when the elastic pad is assembled, which can improve convenience in assembling the elastic pad while efficiently reducing the occupied space for storage of the elastic pad.

In some embodiments, the stop hems are formed by portions of the outer wrapping cover that are folded downwards from the peripheral edges of the cover and extend a predetermined distance.

In some embodiments, the at least one inner core layer is folded downwards from the peripheral edges of the cover and extends a predetermined distance to form a folded layer, and the outer wrapping cover is folded downwards from the peripheral edges of the cover and extends a predetermined distance to form a folded cover, wherein the folded cover wraps the folded layer to form the stop hems.

In some embodiments, the cover further comprises an edge connection structure configured to be connected to a bottom layer of the elastic pad.

In some embodiments, the stop hems and the edge connection structure cooperate to form the elastic pad without enclosed side coverings.

In some embodiments, the edge connection structure includes a plurality of connection ropes spaced apart along a peripheral direction of the elastic pad.

In a second aspect, the present disclosure provides an elastic module, comprising: an elastic support layer comprising a plurality of elastic modules arranged in a transverse direction of the elastic pad; a pad layer laid on the plurality of elastic modules of the elastic support layer; and the cover according to any one of the items of the first aspect, wherein the cover is laid on the pad layer, and the pad layer is received and limited within the inner pace.

In the elastic pad, the plurality of elastic modules may be arranged to form the elastic support layer, the pad layer is laid on the elastic support layer, and the cover as described above is laid on the pad layer, so that the pad layer is received and limited within the inner space. Therefore, the elastic pad according to the present disclosure can effectively improve convenience in assembling and cleaning the elastic pad, while significantly reducing the occupied space for storage of the elastic pad.

In some embodiments, at least two opposing stop hems of the stop hems are connected to a bottom layer of the elastic pad via an edge connection structure.

In some embodiments, the stop hems is extending to a position close to the bottom layer of the elastic pad and keeps a predetermined gap from the bottom layer of the elastic pad, and the length of the stop hems is set so that it can shield at least a part or all of the height of the elastic module.

In some embodiments, the pad layer includes a plurality of inner layers stacked in a thickness direction of the pad layer and an outer cover removably wrapping the plurality of inner layers, wherein the plurality of inner layers comprise an inner elastic layer and an inner flexible layer.

In some embodiments, the elastic pad comprises a plurality of elastic module units, each elastic module unit comprising a fixed bottom plate and a plurality of elastic modules arranged on the fixed bottom plate, wherein the fixed bottom plate comprises splicing sides arranged opposite to each other, and end sides arranged opposite to each other, each of the end sides being disposed with a plurality of connectors, each of which comprises at least one of a rotary detent member and an engagement member, wherein the rotary detent member is configured to swing back and forth about a pivot axis so that it releasably engages with an engagement member of an adjacent elastic module unit, and the engagement member is configured to releasably engage with a rotary detent member of an adjacent elastic module unit; wherein a plurality of the fixed bottom plates are spliced together by engagement of the rotary detent members and the engagement members adjacent to each other, such that the plurality of elastic module units can be assembled into the elastic support layer.

In some embodiments, each corner of every one of the end sides is provided with one of the plurality of connectors.

In some embodiments, each of the end sides is provided with the rotary detent member and the engagement member.

In some embodiments, the rotary detent members disposed on the two opposite end sides are located on one of the diagonal line of the elastic module unit, and the engagement members disposed on the same two opposite end sides are located on the other diagonal line of the elastic module unit, wherein the rotation direction of the rotary detent members are identical.

In some embodiments, the engagement member comprises a snap-in post.

In some embodiments, a receiving groove configured to receive the connectors is formed on a peripheral side surface at each corner of the fixed bottom plate.

In some embodiments, an upper wall of the receiving groove is formed with an operating opening for enabling a user to apply a force to rotate the rotary detent member.

In some embodiments, the rotary detent member comprises a detent hook configured to be releasably snapped into the engagement member of an adjacent elastic module unit and a peg, wherein the rotary detent member is configured to shift between a storage position where the peg is located within the receiving groove and a part of the detent hook extends laterally from the receiving groove, and an engagement position where the detent hook is located in the receiving groove of the adjacent elastic module unit and a part of the peg extends laterally from the receiving groove of the adjacent elastic module unit.

In some embodiments, the rotary detent member is configured to releasably hook a corresponding connection rope on the pad layer.

In some embodiments, the rotary detent member is configured to releasably hook a corresponding connection rope on the cover.

In some embodiments, the rotary detent member comprises a detent hook configured to be releasably snapped into the engagement member of the adjacent elastic module unit and a peg, wherein the rotary detent member is configured to shift between a storage position where the detent hook releasably hooks the corresponding connection rope and an engagement position where the peg releasably hooks the corresponding connection rope.

In some embodiments, each of the splicing sides is formed with a pre-positioning structure configured to engage with a pre-positioning structure formed on a splicing side of a fixed bottom plate of an adjacent elastic module unit.

In some embodiments, the pre-positioning structure comprises a first pre-positioning structure and a second pre-positioning structure arranged at an interval in an extension direction of the splicing sides, the second pre-positioning structure being different from the first pre-positioning structure, wherein the first pre-positioning structure is configured to engage with a second pre-positioning structure of an adjacent elastic module unit, and the second pre-positioning structure is configured to engage with a first pre-positioning structure of an adjacent elastic module unit.

In some embodiments, the first pre-positioning structure located on one side of the elastic module unit is aligned with the second pre-positioning structure located on the other side of the elastic module unit along the transverse direction of the elastic module unit, and the second pre-positioning structure located on the one side of the elastic module unit is aligned with the first pre-positioning structure located on the other side of the elastic module unit along the transverse direction of the elastic module unit.

In some embodiments, the first pre-positioning structure is formed as a pre-positioning bump, and the second pre-positioning structure is formed as a pre-positioning groove.

In some embodiments, the elastic pad is used as an elastic mattress.

In a third aspect, the present disclosure provides furniture, comprising the elastic pad according to the above second aspect.

In addition, the furniture includes, but is not limited to, beds, sofas, chairs, sofa beds, upholstered benches, and the like.

Obviously, elements or features described above in a single embodiment may be used, alone or in combination, in other embodiments.

BRIEF DESCRIPTION OF THE DRAWINGS

Dimensions and proportions in the drawings do not represent the dimensions and proportions of actual products. The drawings are only provided for an illustrative purpose, and some unnecessary elements or features are omitted therefrom for clarity.

REFERENCE SIGNS

Figure 1:
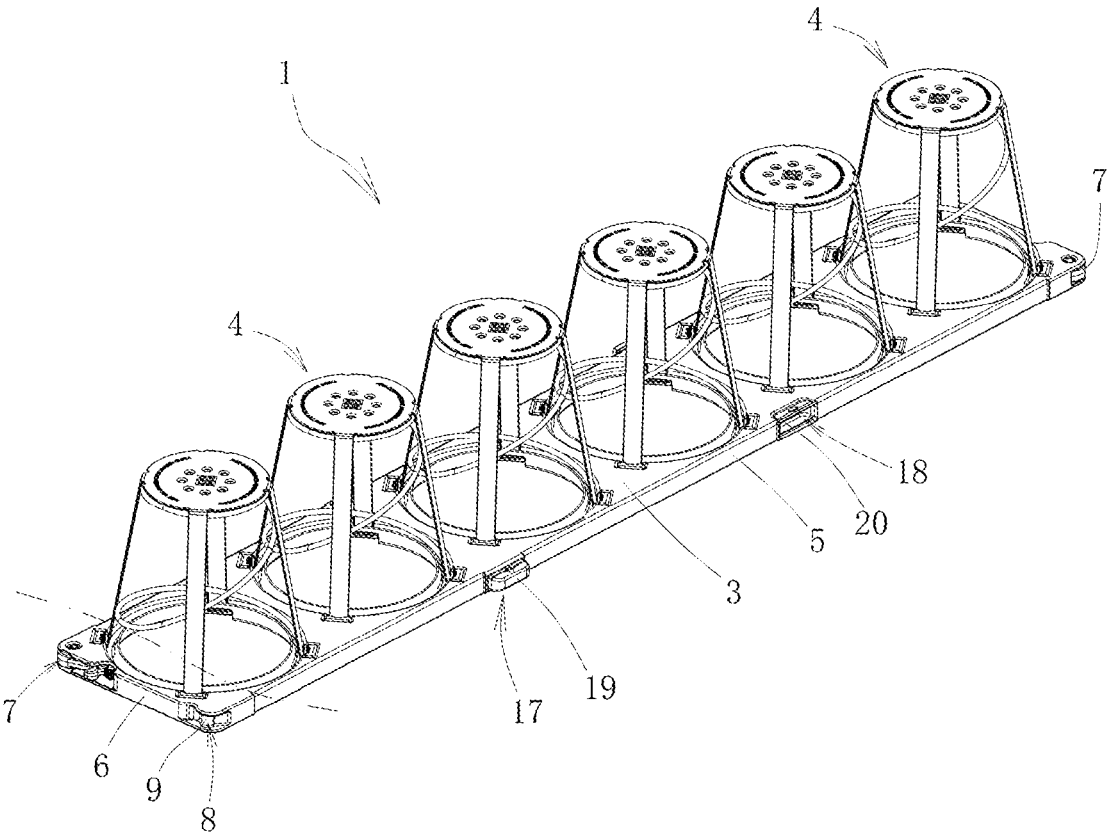
FIG. 1 is a perspective view of an elastic module unit according to a first embodiment, wherein a rotary detent member is in a storage position.

1—elastic module unit, 2—elastic pad, 3—fixed bottom plate, 4—elastic module, 5—splicing side, 6—end side, 7—rotary detent member, 8—engagement member, 9—snap-in post, 10—receiving groove, 11—upper groove wall, 12—operating opening, 13—detent hook, 14—peg, 15—pad layer, 16—connection rope, 17—first pre-positioning structure, 18—second pre-positioning structure, 19—pre-positioning bump, 20—pre-positioning groove, 21—elastic support layer, 22—cover, 23—stop hem, 151—outer cover, 152—inner elastic layer, 153—inner flexible layer, 221—inner core layer, 222—outer wrapping cover, 231—inner space, 2211—hem layer, 2221—hem cover.

DETAILED DESCRIPTION OF EMBODIMENTS

Reference now will be made to the drawings to describe in detail the cover, the elastic pad and the furniture according to the present disclosure. What will be described herein will only involve preferred embodiments of the present disclosure, and those skilled in the art would contemplate, on the basis of the preferred embodiments, other possible embodiments or implementations which also fall into the scope described herein.

In a first aspect, referring to FIGS. 9-15 and 16-17, the cover 22 is applied to the elastic pad 2. The cover 22 includes at least one inner core layer 221 comprising an elastic material layer which may be a sponge layer, a silicone layer or any other elastic material layer, an outer wrapping cover 222 that removably wraps the at least one inner core layer 221 by any means and stop hems 23. The stop hems 23 are folded downwards from the peripheral edge of the cover 22 along the height or thickness direction of the elastic pad 2 and extend for a predetermined distance, forming an inner space 231 configured to receive and shield the pad layer 15 of the elastic pad 2.

In the technical solution according to the first aspect, since the at least one inner core layer 221 of the core 22 includes an elastic material layer, it can efficiently improve the elastic support performance of the cover 22, which in turn further improve the support performance and comfort of the elastic pad. In addition, since the outer wrapping cover 222 removably wraps the at least one inner core layer 221, it is only required to remove and clean the outer wrapping cover 222 when cleaning is to be performed. Moreover, the stop hems 23 extend about the peripheral edges of the cover 23 and thus form the inner space 231 for receiving and shielding the pad layer 15 of the elastic pad 2 when the elastic pad 2 is assembled, which can improve convenience in assembling the elastic pad 2 while efficiently reducing the occupied space for storage of the elastic pad 2.

Further, under a tension action of an edge connection structure which will be described later, the stop hems 23 may be in a tensioned state in which the stop hems 23 is extending downwards to abut against and stop the outermost elastic module 4, thereby effectively preventing movement of the outermost elastic module 4 in the transverse direction of the elastic pad and improving the stability of the elastic module.

In the cover layer 22, the stop hem 23 may be formed as a separate component, and can be connected to the peripheral edge of the outer wrapping cover 222 in multiple ways such as seaming, welding, zipping, snap-fit, or the like.

Figure 16:
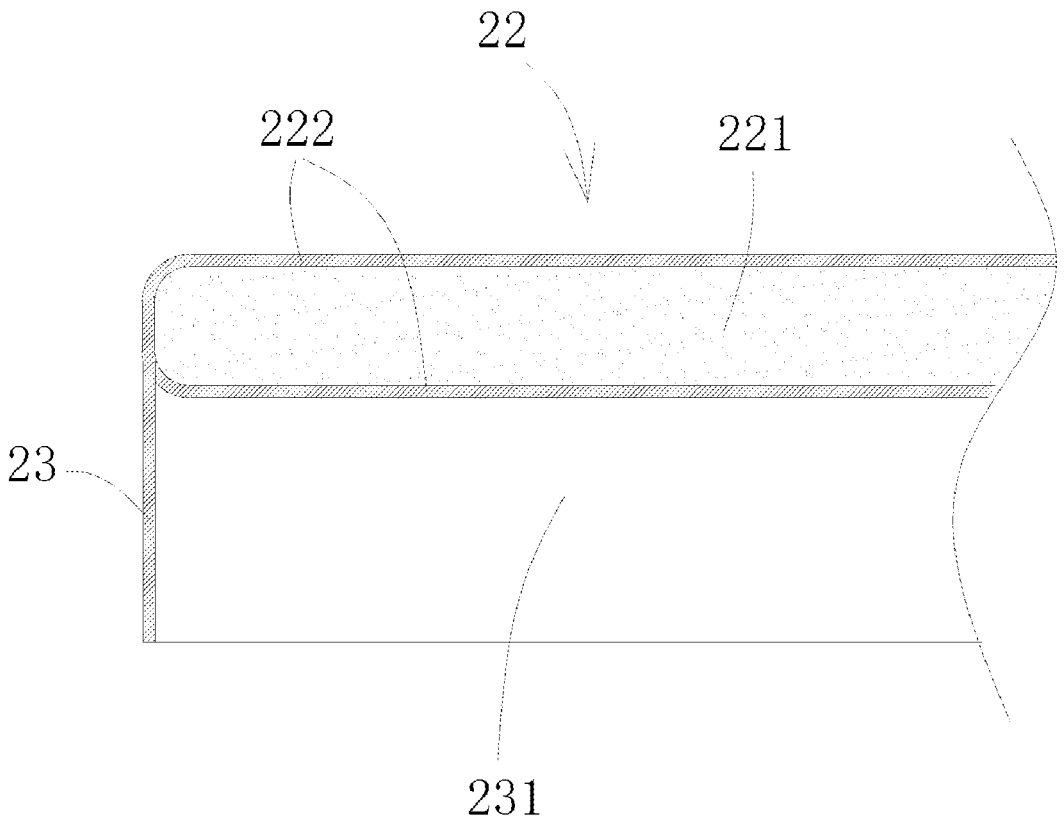
FIG. 16 is a partial sectional view of another cover embodiment.

For example, referring to FIG. 16, the stop hems 23 may be formed by portions of the outer wrapping cover 222 which are folded downwards from the peripheral edge of the cover 222 and extend to a predetermined distance, that is, the stop hems 23 and the outer wrapping cover 222 are formed integrally. In this way, the portions folded downwards from the peripheral edge are limited by means of the integrity of the portions of the outer wrapping cover 222 wrapping at least one inner core layer 221, thereby improving the stability of the stop hems 23.

Figure 17:
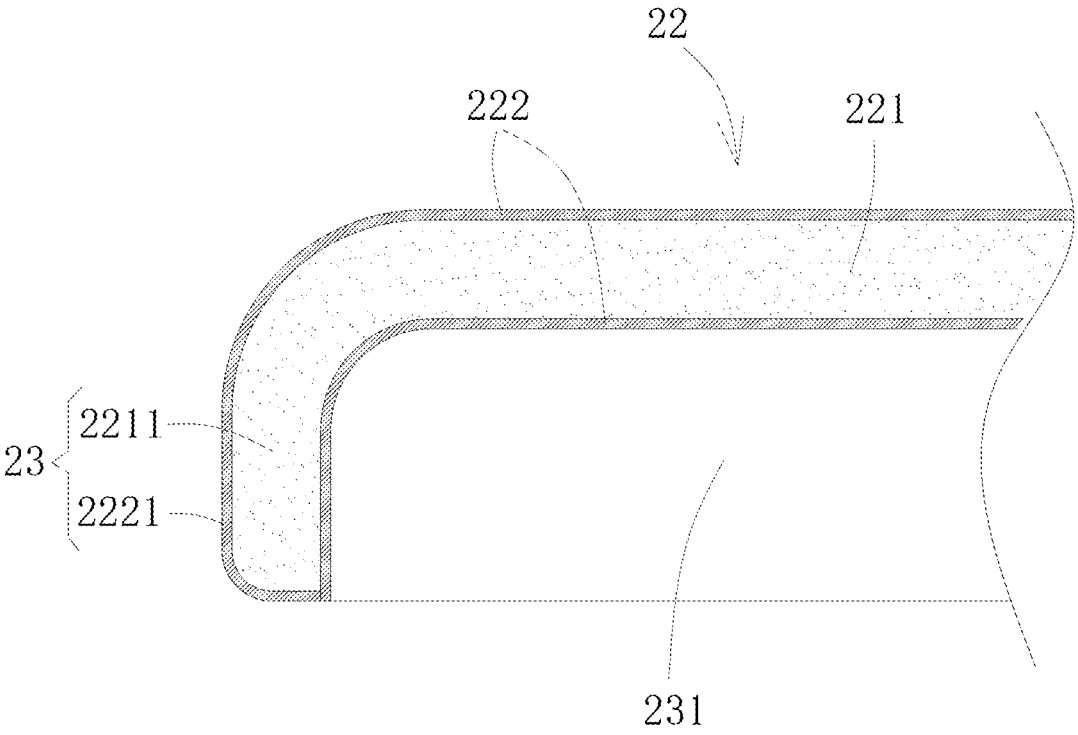
FIG. 17 is a partial sectional view of another cover embodiment.

In the example of FIG. 17, the at least one inner core layer 221 is folded downwards from the peripheral edges of the cover 22 and extends a predetermined distance to form a hem layer 2211, and the outer wrapping cover 222 is folded downwards from the peripheral edges of the cover 22 and extends a predetermined distance to form a hem cover 2221, wherein the hem cover 2221 wraps the folded layer 2211 to form stop hems 23. As such, with the hem layer 2211 and the hem cover 2221 wrapping the hem layer 2211, the strength of the stop hems 23 is increased, so that the reliability of positioning the pad layer received within the inner space 231 is further improved.

In the example of FIGS. 10, 11 and 13-15, the cover 22 further includes an edge connection structure configured to be connected to the bottom layer of the elastic pad. In this way, after being connected to the bottom layer of the elastic pad, the edge connection structure can further straighten and tighten the stop hems 23, to improve the stopping effect of the stop hems 23.

The edge connection structure may be of multiple types. For example, in some embodiments, the edge connection structure may be of a zipper structure, where components of the zipper structure are arranged between the stop hems 23 and the bottom layer of the elastic pad. For another example, in some other embodiments, the stop hems 23 and the edge connection structure cooperate to form an elastic pad 2 without enclosed side coverings. Since no enclosed side coverings are provided, the elastic pad 2 can have a permeable or breathable inner structure, thus improving the breathability and comfort of the elastic pad 2.

Figure 11:
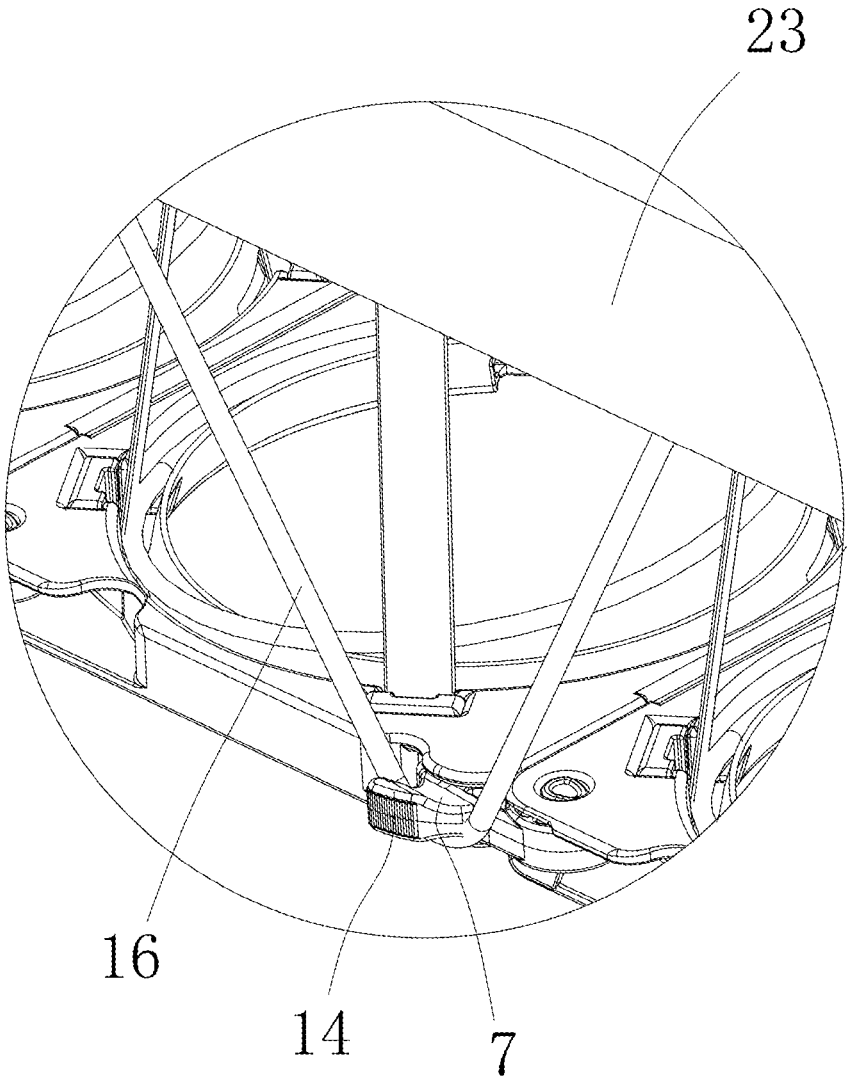
FIG. 11 is an enlarged view of the circled part shown in FIG. 10.
Figure 14:
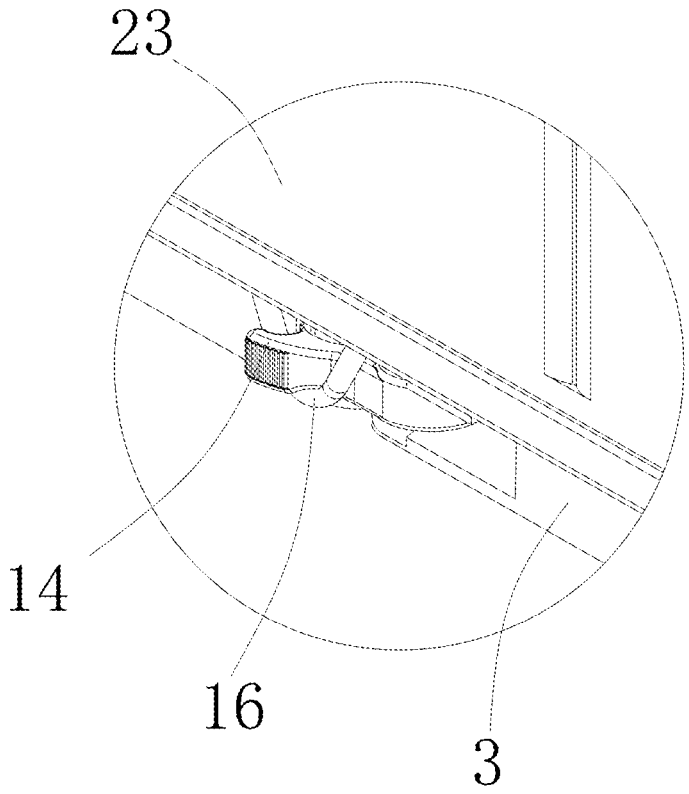
FIG. 14 is an enlarged view of the circled part shown in FIG. 13.
Figure 15:
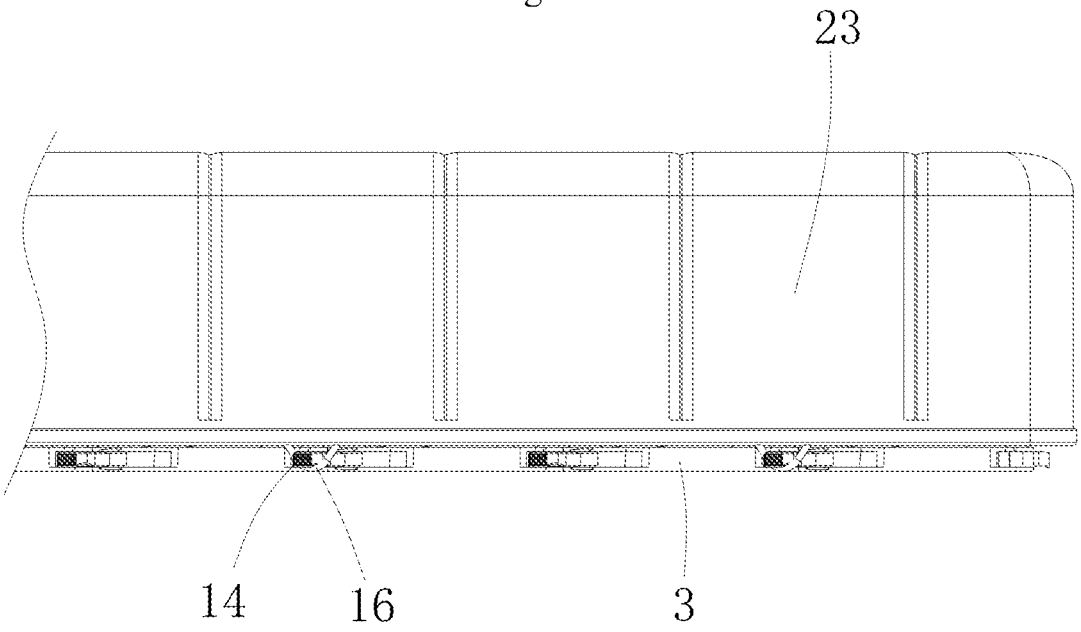
FIG. 15 is a schematic diagram showing a part of the elastic pad of FIG. 13.

Further, the edge connection structure may be of multiple types. And no matter what structure the edge connection structure has, it is sufficient as long as it can connect the bottom layer of the elastic pad with the cover 22 and form the elastic pad without the enclosed side coverings. For example, the edge connection structure may be in the form of a mesh. In this case, with a plurality of mesh holes, the breathability of the elastic pad 2 can be improved. Referring to FIGS. 11 and 14, another kind of the edge connection structure includes a plurality of connection ropes 16 spaced apart from each other in an interval along the peripheral direction of the elastic pad. For example, the connection ropes 16 may be connected at the edge of the cover 22, for example, on the stop hems 23. In this way, the connection ropes 16 only need to be connected to the bottom layer (e.g., the fixed bottom plate 3) of the elastic pad. In addition, the connection ropes 16 may be in form of a plurality of rope loops arranged independently from each other at intervals or may extend continuously in a wavy manner.

Figure 12:
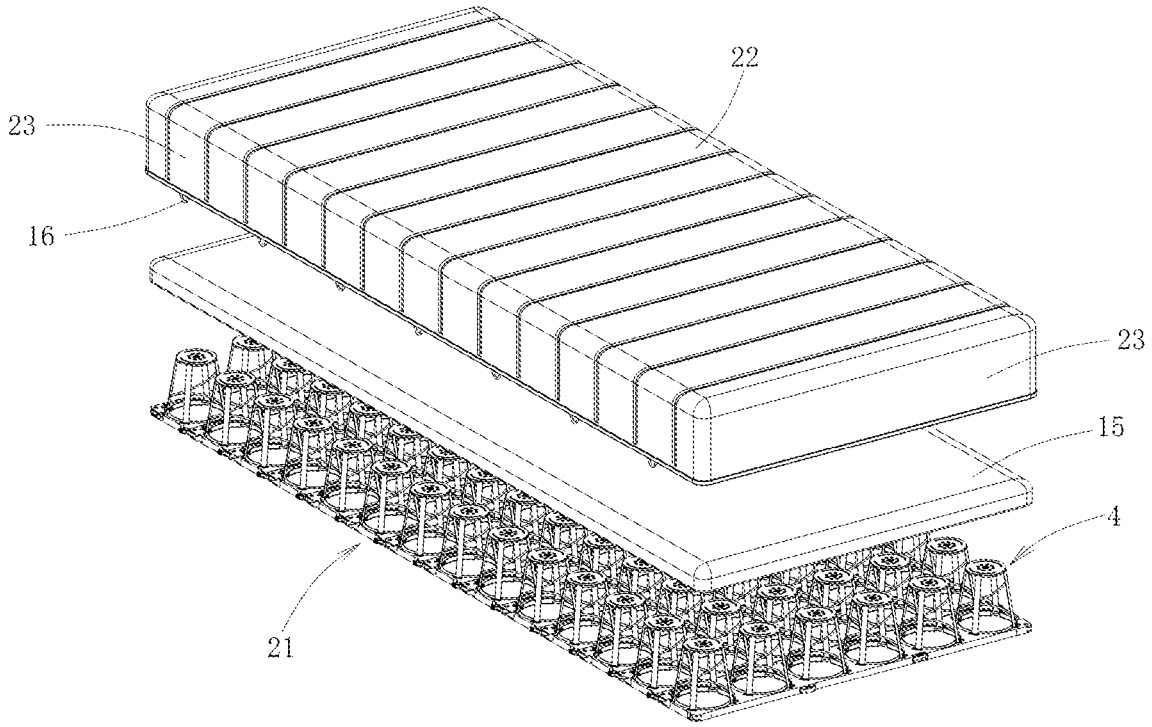
FIG. 12 an exploded view exemplarily illustrating an elastic pad according to the second embodiment, wherein the elastic support layer shown in FIG. 8 and a second structure of a cover are shown.

In a second aspect, as shown in FIG. 12, an elastic pad 2 comprises: an elastic support layer 21 including a plurality of elastic modules 4 arranged in the transverse direction of the elastic pad; a pad layer 15 laid on the plurality of elastic modules 4 of the elastic support layer 21; and the cover 22 according to any one of the items of the first aspect, wherein the cover is laid on the pad layer 15, wherein the pad layer 15 is received and limited in the inner space 231. In the elastic pad, the plurality of elastic modules may be arranged to form the elastic support layer, the pad layer is laid on the elastic support layer, and the cover is laid on the pad layer, so that the pad layer is received and limited within the inner space. Therefore, the elastic pad can effectively improve the convenience in assembling and cleaning the elastic pad while significantly reducing the occupied space for storage of the elastic pad.

Figure 10:
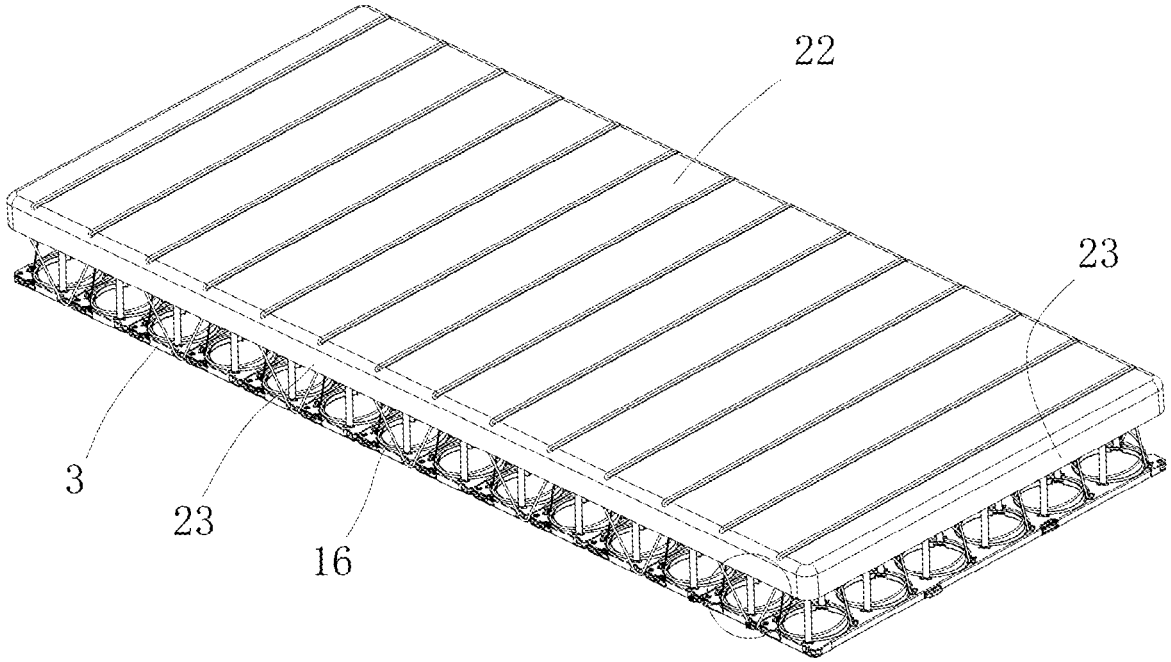
FIG. 10 is a schematic perspective view of the elastic pad shown in FIG. 9 in an assembled state.

The stop hems 23 may be connected to the bottom layer of the elastic pad via the edge connection structures. Optionally at least two opposing stop hems 23 of the stop hems 23 are connected to the bottom layer of the elastic pad via the edge connection structures, as shown in FIGS. 10 and 12. In this way, the pad assembling step is easier and more convenient, with improved reliability of the connection of the cover 22.

Figure 13:
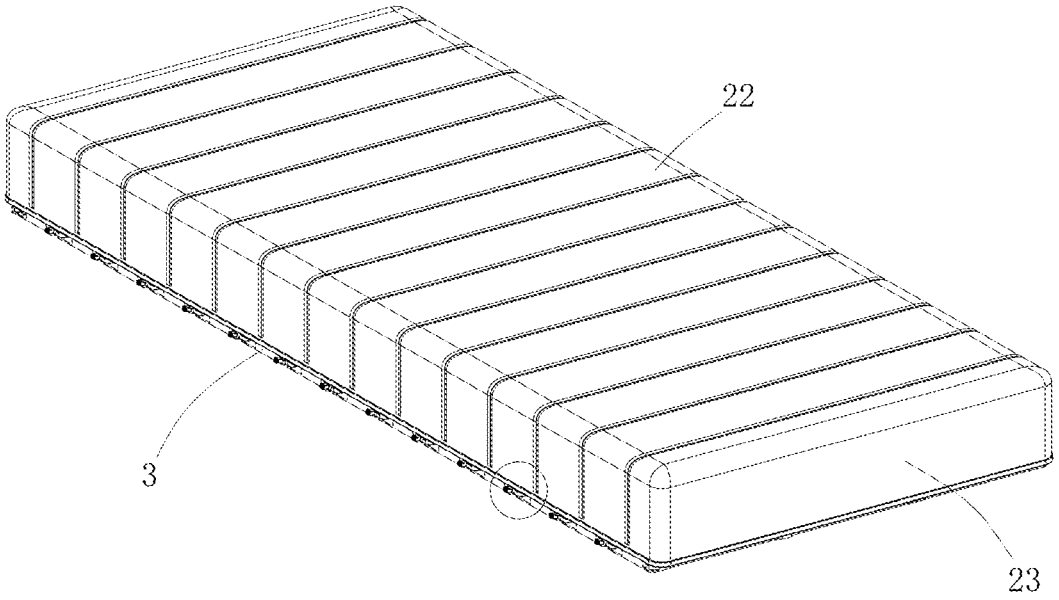
FIG. 13 is a schematic perspective view showing the elastic pad of FIG. 12 in an assembled state.

As shown in FIGS. 10 and 13, the stop hems 23 extend to a position close to the bottom layer of the elastic pad and keep a predetermined gap from the bottom layer of the elastic pad. The length of the stop hems 23 is set so that it can shield at least a part or all of the height of the elastic module 4. The appearance and breathability of the elastic pad are improved.

Figure 18:
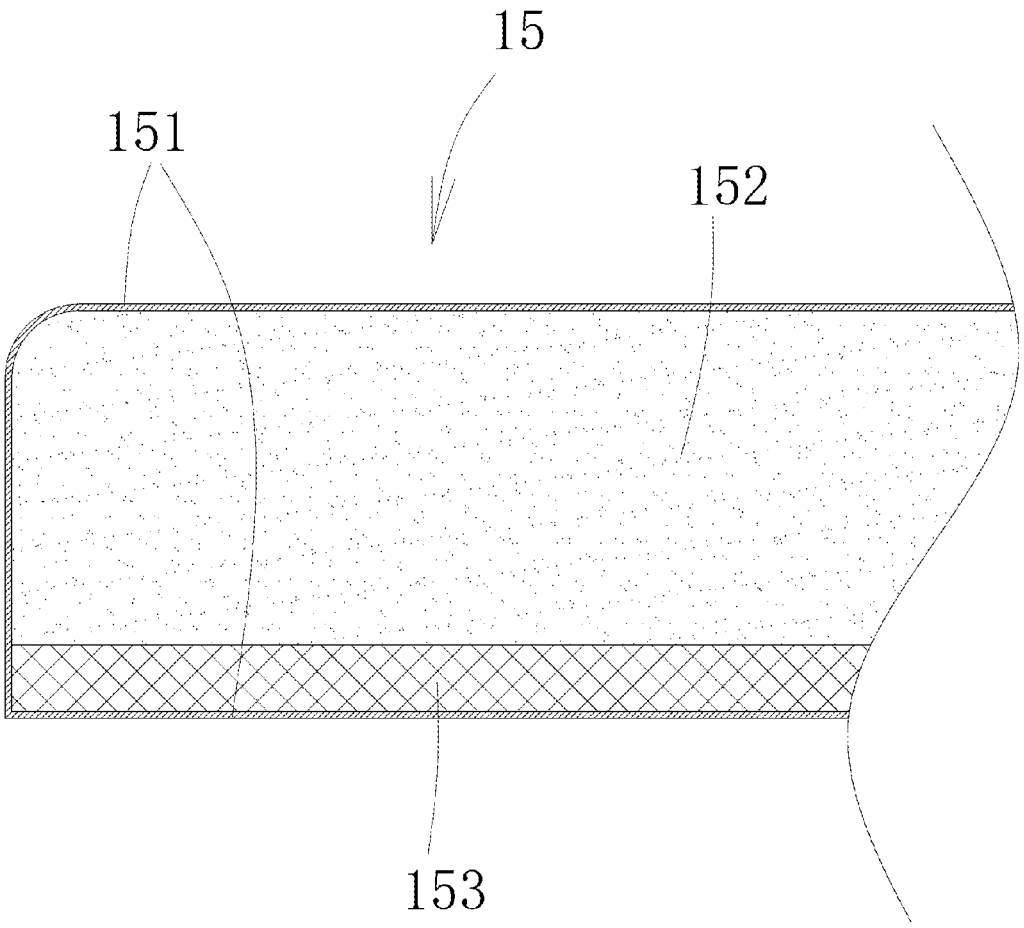
FIG. 18 is a partial sectional view of a pad layer.

The pad layer 15 may be a single pad layer, for example, a single sponge layer, or a single silicone layer. Referring to FIG. 18, the pad layer may include a plurality of inner layers stacked in the thickness direction of the pad layer, and an outer cover 151 removably wrapping a plurality of inner layers that include an inner elastic layer 152 and an inner flexible layer 153. Preferably, the inner elastic layer 152 is located above the inner flexible layer 153 in the thickness direction of the pad layer. In this way, the inner elastic layer 152 can provide a good elastic support, and the inner flexible layer 153 can be in a stable and reliable contact with the elastic module below it, to improve the durability.

The elastic support layer 21 may be of multiple types. For example, in some embodiments, the elastic support layer 21 may include an integral bottom layer, and a plurality of elastic modules 4 arranged on the integral bottom layer.

In another example shown in FIGS. 1-8, the elastic pad includes a plurality of elastic module units 1. Each elastic module unit 1 comprises a fixed bottom plate 3 and a plurality of elastic modules 4 arranged on the fixed bottom plate 3. The fixed bottom plate 3 includes splicing sides 5 arranged opposite to each other, and end sides 6 arranged opposite to each other. Each end sides 6 being disposed with a plurality of connectors, each connector comprises at least one of a rotary detent member 7 and an engagement member 8. The rotary detent member 7 is configured to swing back and forth about the pivot axis so that it releasably engages with the engagement member 8 of the adjacent elastic module unit 1. The engagement member 8 is configured to releasably engage with the rotary detent member 7 of the adjacent elastic module unit 1. A plurality of fixed bottom plates 3 can be spliced together by engagement of rotary detent members 7 and engagement members 8 adjacent to each other such that a plurality of elastic module units 1 can be assembled into an elastic support layer 21 of the elastic pad 2.

Accordingly, since the fixed bottom plate 3 includes end sides 6 arranged opposite to each other, each end side 6 includes a plurality of connectors each including at least one of a rotary detent member 7 and an engagement member 8, the rotary detent member 7 is configured to swing about a pivot axis to thus releasably engage with an engagement member 8 of an adjacent elastic module unit 1. The engagement member 8 is configured to releasably engage with a rotary detent member 7 of an adjacent elastic module unit 1. When the elastic module units 1 are assembled into the elastic pad 2, splicing sides 5 of a plurality of fixed bottom plates 3 are spliced sequentially, and the adjacent bottom fixed bottom plates 3 are connected by engagement of the rotary detent member 7 and the engagement member 8 of the two. In this way, all the fixed bottom plates 3 can be spliced by engagement of the rotary detent member 7 and the engagement member 8 so that all the fixed bottom plates 3 can be assembled into an elastic support layer 21 of the elastic pad 2. Therefore, the elastic module units 1 can significantly improve convenience in assembling the elastic pad 2 and can facilitate disassembling for storage to effectively reduce the occupied space for storing the elastic pads.

The elastic module unit 1 may be of multiple types. For example, for a first type of elastic module unit 1, some elastic module units 1 where end sides 6 of fixed bottom plates 3 include a plurality of rotary detent members 7 are used as first elastic module units, and some other elastic module units 1 where end sides 6 of fixed bottom plates 3 include a plurality of engagement members 8 are used as second elastic module units. As such, the plurality of engagement members 8 of a second elastic module unit can engage rotary detent members 7 of a preceding adjacent first elastic module unit and rotary detent members 7 of a following first elastic module unit. Accordingly, a plurality of elastic module units 1 can be assembled together.

In a second example of an elastic module unit 1 shown in FIGS. 1-7, each end side 6 of the fixed bottom plate 3 of the elastic module unit 1 is provided with a rotary detent member 7 and an engagement member 8. A rotary detent member 7 of an elastic module unit 1 engages an engagement member 8 of a preceding adjacent elastic module 1, and an engagement member 8 of an elastic module unit 1 engages a rotary detent member 7 of a following adjacent elastic module unit 1. Therefore, a plurality of elastic module units 1 can be assembled together.

Figure 6:
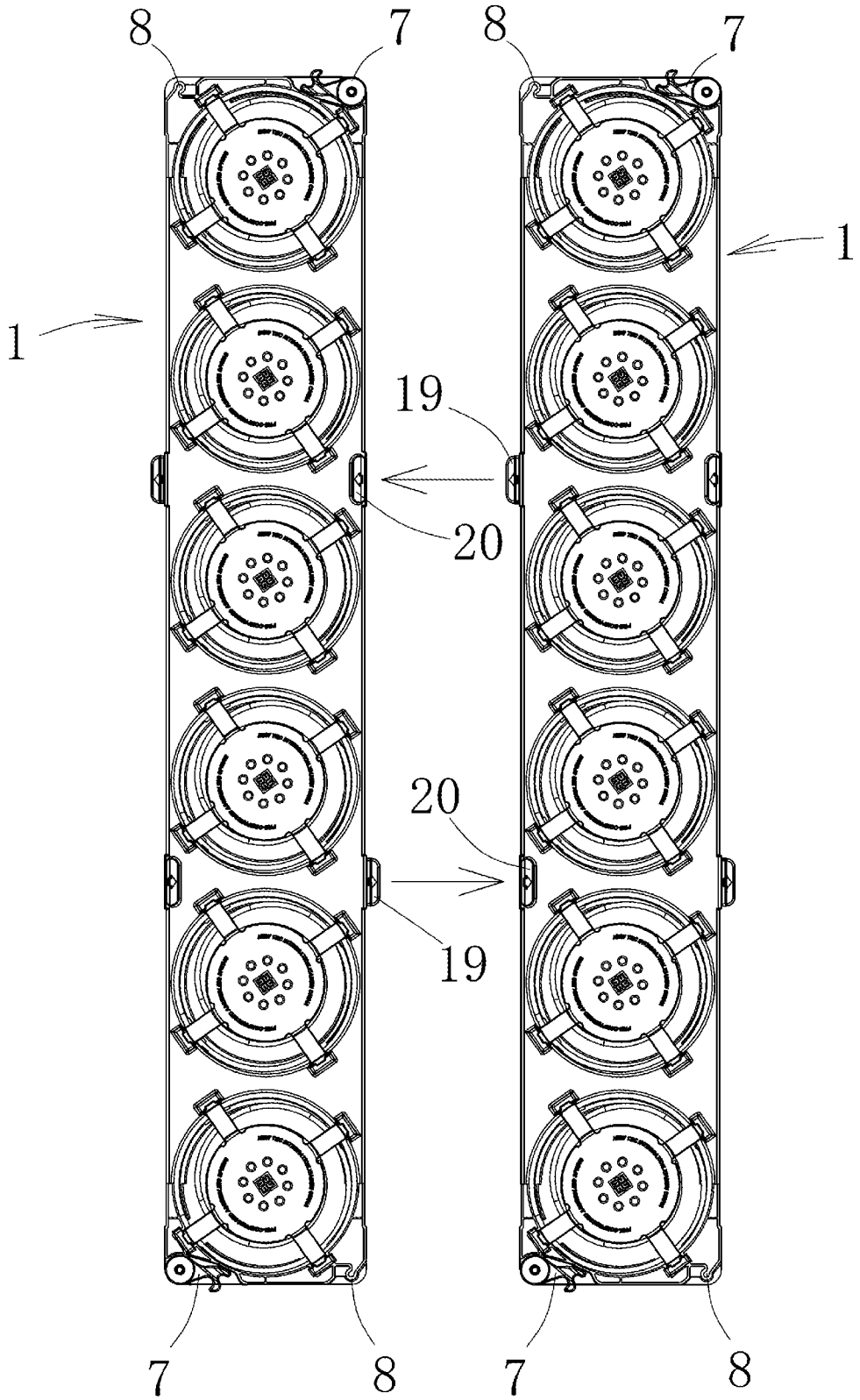
FIG. 6 is a schematic view showing a structure formed by splicing two elastic module units according to the second embodiment.

The connectors may be disposed at any position of the end side 6. For example, connectors may be disposed at the middle position of the end side 6 or may be disposed at other position of the end side 6 close to the middle position. Referring to FIG. 6, one of the plurality of connectors may be disposed at a corner of each end side 6. This design can make full use of the corner of the end side 6 for arrangement of connectors and facilitate a connection between adjacent fixed bottom plates 3.

As described above, in the second type of elastic module unit 1, the end side 6 of the fixed bottom plate 3 of the elastic module unit 1 includes a rotary detent member 7 and an engagement member 8. Therefore, in some embodiments, referring to FIG. 6, at the corner of each end side 6 are disposed a rotary detent member 7 and an engagement member 8.

Figure 7:
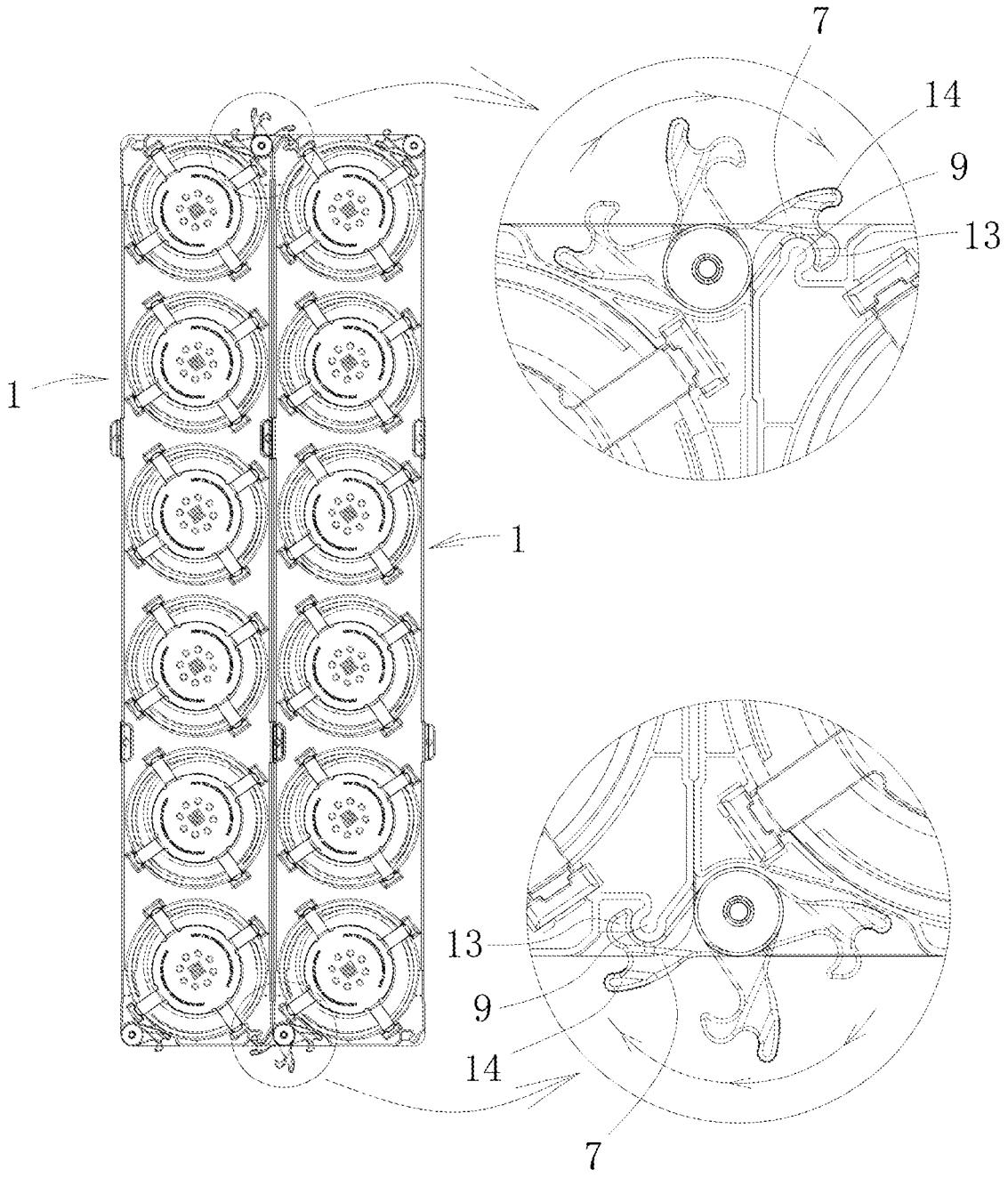
FIG. 7 is a schematic diagram of a structure where the two elastic module units of FIG. 6 are in an engagement position, wherein swing positions of the two rotary detent members are represented by dotted lines.
Figure 8:
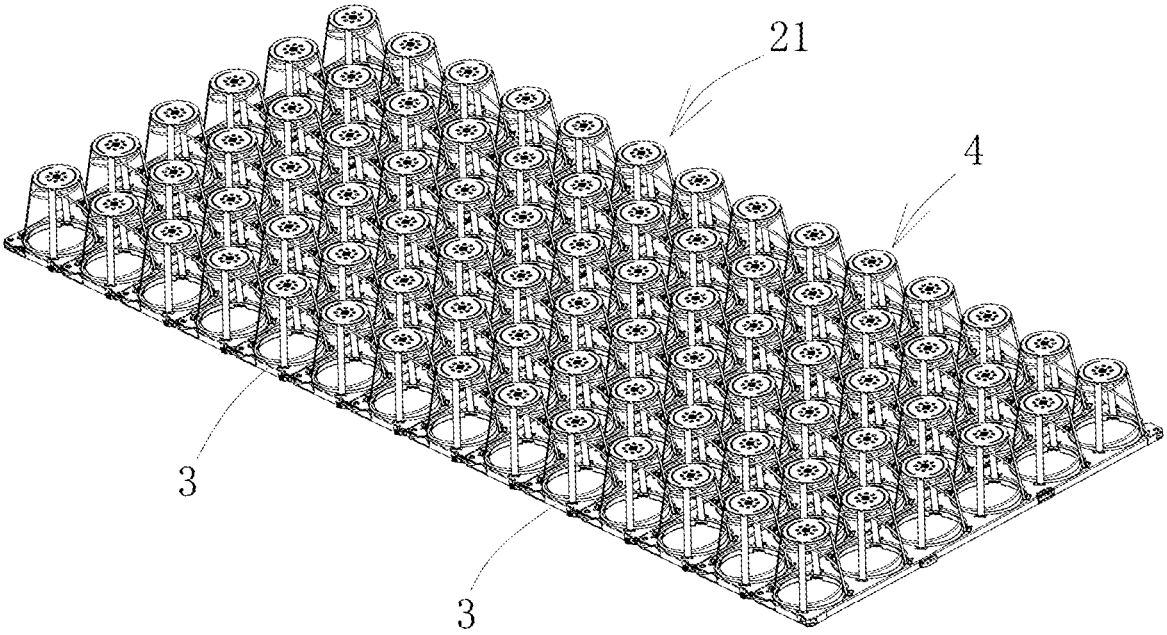
FIG. 8 is a perspective view of an elastic support layer of an elastic pad formed by splicing a plurality of elastic module units in a splicing method as shown in FIG. 7.
Figure 9:
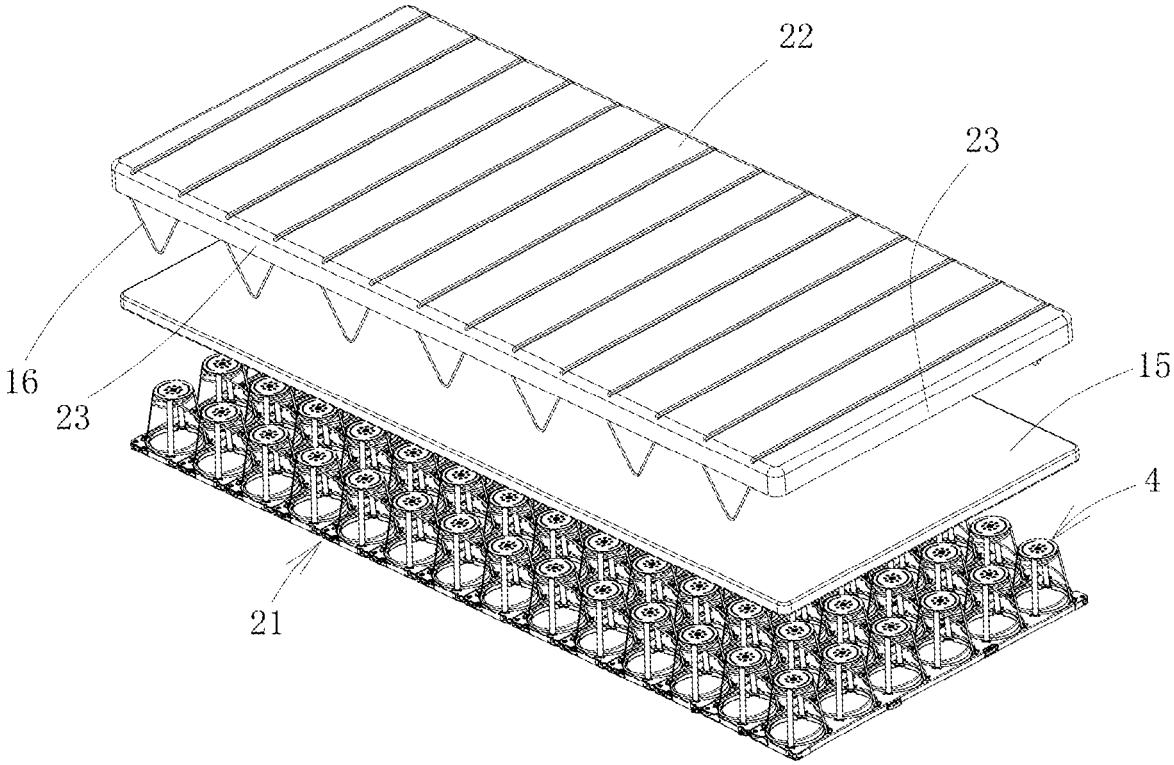
FIG. 9 an exploded view exemplarily illustrating the elastic pad according to the first embodiment, wherein the elastic support layer shown in FIG. 8 and a first embodiment of a cover are shown.

To improve the connection convenience among a plurality of fixed bottom plates 3, rotary detent members 7 may be disposed on the two opposite end sides 6 located in one diagonal line of the elastic module unit 1. Engagement members 8 disposed on the same two opposite end sides 6 may be located in the other diagonal line of the elastic module unit 1, wherein the rotation direction of the rotary detent members 7 are identical. Referring to FIGS. 6 and 7, rotary detent members 7 of any two fixed bottom plates 3 can rotate in the same rotation direction to thus connect any two fixed bottom plates 3.

In other embodiments, the rotary detent members 7 may differ in rotation direction.

In the elastic module unit 1, the engagement member 8 may be of multiple types of structures. For example, for a structure type of engagement member 8, the engagement member 8 may be a rotary engagement member 7. In this way, rotary engagement members 7 of adjacent fixed bottom plates 3 can engage. For another example, for another structure type of engagement member 8, referring to FIGS. 2, 4 and 7, the engagement member 8 includes a snap-in post 9. When the rotary engagement member 7 engages the snap-in post 9, adjacent fixed bottom plates 3 are connected, and when the rotary engagement member 7 disengages from the snap-in post 9, the adjacent fixed bottom plates 3 are disconnected.

Figure 2:
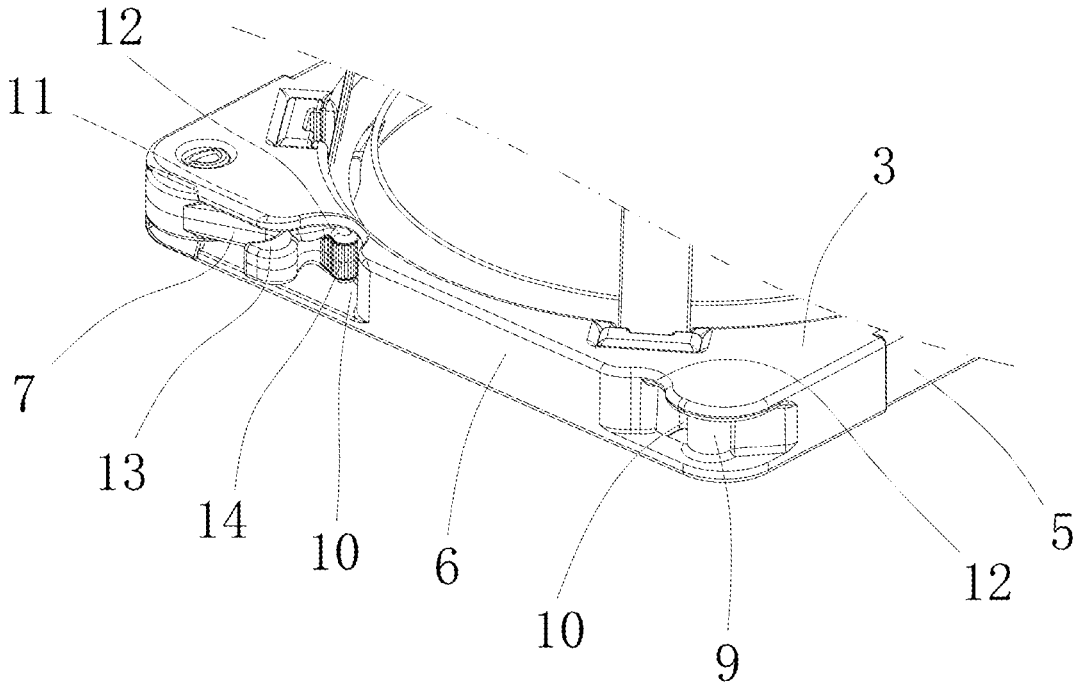
FIG. 2 is a schematically structural view showing a part of the elastic module unit of FIG. 1.
Figure 3:
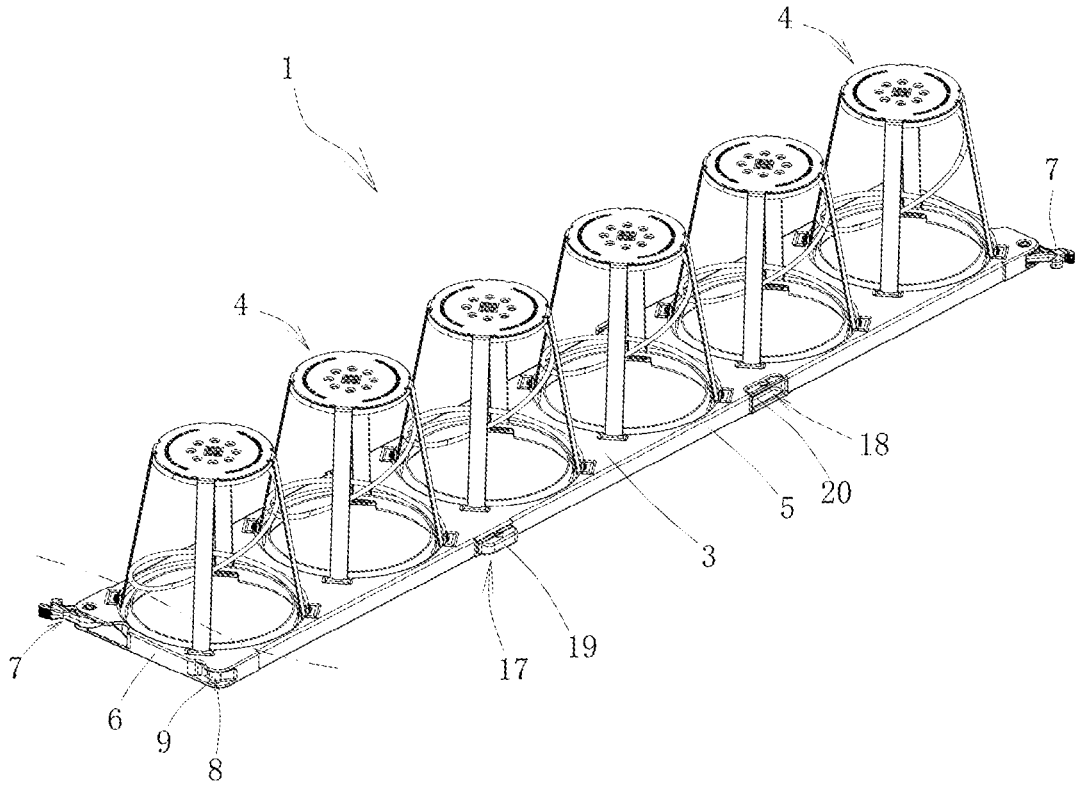
FIG. 3 is a perspective view in which the rotary detent member of the elastic module unit is shifted in an engagement position.
Figure 4:
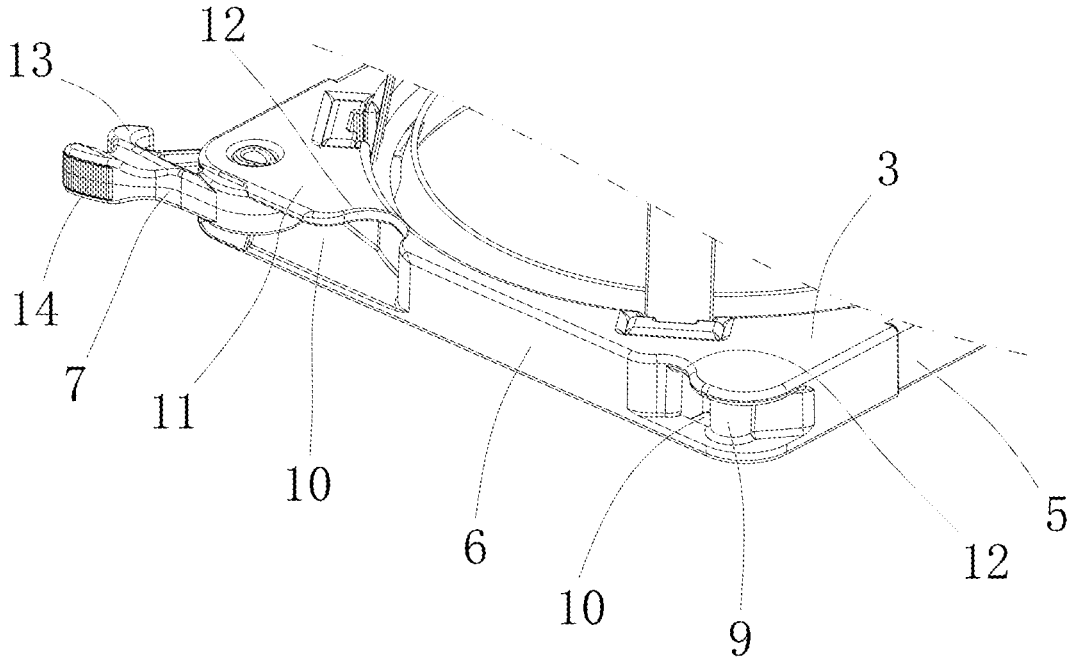
FIG. 4 is a schematically structural view showing a part of the elastic module unit of FIG. 3.

In some embodiments, for example, referring to FIGS. 2, 4 and 6, a receiving groove 10 for receiving connectors is formed on a peripheral side surface of each corner of the fixed bottom plate 3. The connectors, such as the rotary detent member 7 and the engagement member 8, may be located in the respective corresponding receiving grooves 10, to prevent most of the connectors from being exposed from the circumferential side surface of the fixed bottom plate 3.

For example, referring to FIGS. 2 and 4, the receiving groove 10 may include an upper groove wall 11, i.e., a receiving groove 10 extending transversely is formed on the circumferential side surface of the corner of the fixed bottom plate 3. At this time, the upper side groove wall 11 is formed with an operating opening 12 for enabling a user to apply a force to rotate the rotary detent member 7. When connecting the respective fixed bottom plates, the operator can conveniently drive the rotary detent member 7 via the operating opening 2.

Referring to FIG. 6, the receiving groove 10 may not include an upper side wall 11, i.e., a receiving recess is formed in the corner of the upper surface of the fixed bottom plate 3, the receiving recess extends outwards to the circumferential side surface of the fixed bottom plate to be used as the receiving groove 10, and at this time, the connectors, such as a rotary detent member 7 and an engagement member 8, may be located in the respective corresponding receiving recess.

The rotary detent member 7 may be of multiple structures. For example, referring to FIGS. 2, 4 and 7, the rotary detent member 7 may include a detent hook 13 and a peg 14, wherein the detent hook 13 is configured to be releasably snapped into an engagement member 8 of an adjacent elastic module unit 1. The rotary detent member 7 may be configured to fit between a storage position and an engagement position. In the storage position, the peg 14 is located within the receiving groove 10, and a part of the detent hook 13 extends laterally out from the receiving groove 10, so that an operator can conveniently operate the detent hook 13 via a part of the detent hook 13 to drive the rotary detent member 7 to rotate. In the engagement position, the detent hook 13 is located within the receiving groove of the adjacent elastic module unit, and a part of the peg 14 extends laterally out from the receiving groove 10 of the adjacent elastic module unit, so that an operator can conveniently operate the peg 14 via the part thereof to drive the rotary detent member 7 to rotate.

In the example of FIG. 7, the rotary detent member 7 is configured to hook a connection rope 16 fixed on a pad layer 15 of the elastic pad 2. By hooking the connection rope 16 onto the rotary detent member 7, the elastic pad can form an elastic pad 2 without enclosed sides. Since no enclosed sides are provided, the elastic pad 2 has a permeable or breathable inner structure, thus improving the breathability and comfort of the elastic pad 2. When it is required to store the elastic pad 2, the connection rope 16 and the rotary detent member 7 are released, and the respective fixed bottom plates 3 are disconnected from each other, enabling fast and convenient disassembling for storage. This can effectively facilitate transportation of the elastic pad and reduce the storage space. In addition, the connection rope 16 may be a separate connection rope or may be a part of a mesh rope of a mesh sidewall.

The rotary detent member 7 may be configured to hook a connection rope 16 fixed on the cover 22. By hooking the connection rope 16 onto the rotary detent member 7, the elastic pad can form an elastic pad 2 without enclosed sides. Since no enclosed sides are provided, the elastic pad 2 has a permeable or breathable inner structure, thus improving the breathability and comfort of the elastic pad 2. To store the elastic pad 2, the connection rope 16 and the rotary detent member 7 are released, and the respective fixed bottom plates 3 are disconnected from each other, enabling fast and convenient disassembling for storage. This can effectively facilitate transportation of the elastic pad and reduce the storage space. In addition, the connection rope 16 may be a separate connection rope or may be a part of a mesh rope of a mesh sidewall.

The rotary detent member 7 may be of multiple types. Irrespective of type, the rotary detent member 7 can be used as long as it can hook the connection rope 16. For example, in some embodiments, referring to FIG. 7, the rotary detent member 7 includes a detent hook 13 and a peg 14, where the detent hook 13 is configured to be releasably snapped into the engagement member 8 of an adjacent elastic module unit 1. Wherein, the rotary detent member 7 is configured to shift between a storage position and an engagement position. In the storage position, the peg 14 is located within the receiving groove 10, and the detent hook 13 is configured to hook the connection rope 16 (e.g., a part of the detent hook 13 extending laterally out from the receiving groove 10). In the engagement position, the detent hook 13 is located within the receiving groove of the adjacent elastic module unit, and the detent hook 14 is configured to hook the connection rope 16 (e.g., a part of the peg 14 extending laterally out from the receiving groove 10 of the adjacent elastic module unit).

To improve the splicing accuracy and convenience of the respective fixed bottom plates 3, for example, referring to FIGS. 1, 3, 5 and 6, each of the splicing sides 5 may be formed with a pre-positioning structure configured to engage with a pre-positioning structure formed on a splicing side 5 of a fixed bottom plate 3 of an adjacent elastic module unit 1. When a plurality of elastic module units are spliced, the pre-positioning structures of the fixed bottom plates 3 of the adjacent elastic module units engage each other to pre-position the respective fixed bottom plates 3, and the rotary detent member 7 and the engagement member 8 of the adjacent fixed bottom plates 3 then engage each other.

The pre-positioning structure may be of multiple types. Irrespective of type, the pre-positioning structure can be used as long as it can pre-position the adjacent fixed bottom plates 3. For example, referring to FIGS. 1 and 3, the pre-positioning structure includes a first pre-positioning structure 17 and a second pre-positioning structure 18 arranged at an interval in an extension direction of the splicing side, wherein the second pre-positioning structure 18 is different from the first pre-positioning structure 17. Wherein, the first pre-positioning structure 17 is configured to engage with a second pre-positioning structure 18 of an adjacent elastic module unit 1, and the second pre-positioning structure 18 is configured to engage with a first pre-positioning structure 17 of an adjacent elastic module unit 1. With the engagement of the first pre-positioning structure 17 and the second pre-positioning structure 18 of adjacent fixed bottom plates, the pre-positioning balance of adjacent fixed bottom plates can be further improved.

In some embodiments, the second pre-positioning structure 18 is identical to the first pre-positioning structure 17.

Figure 5:
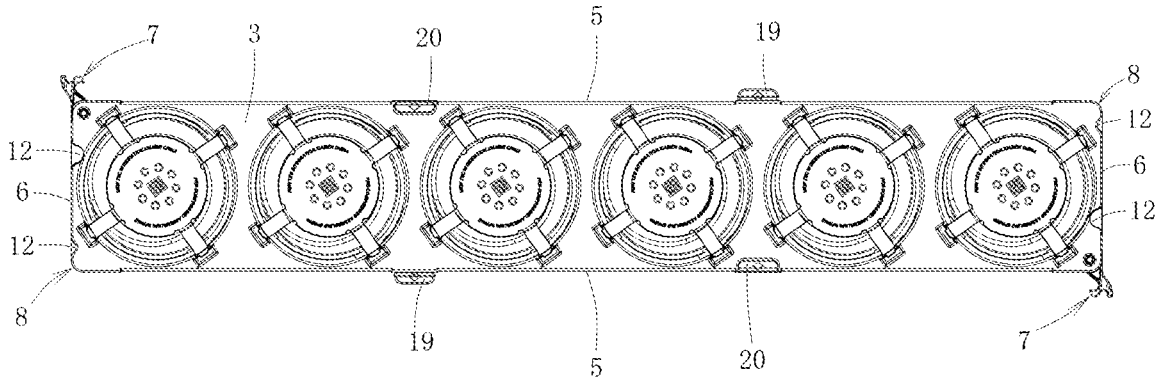
FIG. 5 is a schematic top view of a structure of the elastic module unit shown in FIG. 3.

For example, referring to FIG. 5, the first pre-positioning structure 17 located on one side of the elastic module unit is aligned with the second pre-positioning structure 18 located on the other side of the elastic module unit along a transverse direction of the elastic module unit (i.e., the height direction of FIG. 5, or the width direction of the fixed bottom plate 3 when the fixed bottom plate 3 is rectangular), and the second pre-positioning structure 18 located on the one side of the elastic module unit is aligned with the first pre-positioning structure 17 located on the other side of the elastic module unit along the transverse direction of the elastic module unit. When adjacent fixed bottom plates 3 are spliced, it is only required to align the fixed bottom plates 3 with each other, to further improve convenience in pre-positioning engagement.

The first pre-positioning structure 17 and the second pre-positioning structure 18 are engageable hook and groove structures, respectively. Alternatively, referring to FIGS. 1, 3 and 5, for example, the first pre-positioning structure 17 is formed as a pre-positioning bump 19, and the second pre-positioning structure 18 is formed as a pre-positioning groove 20. When adjacent fixed bottom plates 3 are spliced, it is only required to align the fixed bottom plates 3 with each other, the pre-positioning bump 19 is then embedded into the pre-positioning groove 20 upon pushing the fixed bottom plates 3, and the adjacent fixed bottom plates 3 are pre-positioned and engaged.

In addition, the elastic pad 2 can be applied to any use and situation as desired. For example, the elastic pad 2 may be used as an outdoor or indoor pad. For example, the elastic pad 2 may be used as an elastic mattress, a sofa cushion, a chair cushion and a bench cushion.

In a third aspect, the present disclosure provides a furniture comprising the elastic pad 2 according to the above second aspect. In the case, as stated above, with the elastic pad 2, the furniture exhibits good performance in stability and comfort while the furniture cost can be reduced, thus improving the overall quality.

The scope of protection of the present disclosure is defined only by the appended claims. Given the teaching of the present disclosure, those skilled in the art could easily envision using alternative structures of those disclosed herein as feasible alternative embodiments or implementations, and combining the embodiments or implementations disclosed herein to form new embodiments or implementations, which should all fall into the scope defined by the appended claims.

I claim:

1. A cover for an elastic pad, wherein the cover comprises: at least one inner core layer comprising an elastic material layer; an outer wrapping cover comprising a top wall, a bottom wall and a side wall to enclose and form a receiving space, the outer wrapping cover configured to selectively and removably enclose wrapping the at least one inner core layer within the receiving space; and stop hems folded downwards from peripheral edges of the cover along a thickness direction of the elastic pad and extending a predetermined distance, thereby forming an inner space with an open end configured to selectively and removably receive and shield a pad layer of the elastic pad.

2. The cover of claim 1, wherein the stop hems are formed by portions of the outer wrapping cover that are folded downwards from the peripheral edges of the cover and extend the predetermined distance.

3. The cover of claim 1, wherein the at least one inner core layer is folded downwards from the peripheral edges of the cover and extends the predetermined distance to form a folded layer, and the outer wrapping cover is folded downwards from the peripheral edges of the cover and extends the predetermined distance to form a folded cover, wherein the folded cover wraps the folded layer to form the stop hems.

4. The cover of claim 1, further comprising an edge connection structure configured to be connected to a bottom layer of the elastic pad.

5. The cover of claim 4, wherein the stop hems and the edge connection structure cooperate to form the elastic pad without enclosed side coverings.

6. The cover of claim 5, wherein the edge connection structure comprises a plurality of connection ropes spaced apart along a peripheral direction of the elastic pad.

7. An elastic pad comprising:

an elastic support layer comprising a plurality of elastic modules arranged in a transverse direction of the elastic pad;

a pad layer laid on the plurality of elastic modules of the elastic support layer; and the cover of claim 1;

wherein the cover is laid on the pad layer, and the pad layer is received and limited within the inner space.

8. The elastic pad of claim 7, wherein at least two opposing stop hems are connected to a bottom layer of the elastic pad via an edge connection structure.

9. The elastic pad of claim 7, wherein the stop hems extend to a position adjacent to a bottom layer of the elastic pad and keeps a predetermined gap from the bottom layer of the elastic pad, and the length of the stop hems is set so that the stop hems are configured to shield at least a part or all of a height of the elastic module.

10. The elastic pad of claim 7, wherein the pad layer includes a plurality of inner layers stacked in a thickness direction of the pad layer, and an outer cover removably wrapping the plurality of inner layers, wherein the plurality of inner layers comprise an inner elastic layer and an inner flexible layer.

11. The elastic pad of claim 7, comprising a plurality of elastic module units, each elastic module units comprises a fixed bottom plate and the plurality of elastic modules arranged on the fixed bottom plate, the fixed bottom plate comprises splicing sides arranged opposite to each other, and end sides arranged opposite to each other, and each of the end sides being disposed with a plurality of connectors, each of which comprise at least one of a rotary detent member and an engagement member, the rotary detent member is configured to swing back and forth about a pivot axis so that the rotary detent member releasably engages with an engagement member of an adjacent elastic module unit, and the engagement member is configured to releasably engage a rotary detent member of an adjacent elastic module unit; wherein a plurality of the fixed bottom plates are spliced together by engagement of the rotary detent members and the engagement members adjacent to each other, such that the plurality of elastic module units are configured to be assembled into the elastic support layer.

12. The elastic pad of claim 11, wherein each corner of every one of the end sides is provided with one of the plurality of connectors.

13. The elastic pad of claim 11, wherein each of the end sides is provided with the rotary detent member and the engagement member.

14. The elastic pad of claim 13, wherein the rotary detent members are disposed on the two opposite end sides located on one diagonal line of the elastic module unit; the engagement members are disposed on the same two opposite end sides on the other diagonal line of the elastic module unit, and rotation direction of the rotary detent members is the same.

15. The elastic pad of claim 11, wherein the engagement member comprises a snap-in post.

16. The elastic pad of claim 11, wherein a receiving groove configured to receive the connectors is formed on a peripheral side surface at each corner of the fixed bottom plate.

17. The elastic pad of claim 16, wherein an upper groove wall of the receiving groove is formed with an operating opening for enabling a user to apply a force to rotate the rotary detent member.

18. The elastic pad of claim 16, wherein the rotary detent member comprises a detent hook and a peg, the detent hook is configured to be releasably snapped into the engagement member of an adjacent elastic module unit, the rotary detent member is configured to shift between a storage position where the peg is located within the receiving groove and a part of the detent hook extends laterally from the receiving groove, and an engagement position where the detent hook is located in the receiving groove of the adjacent elastic module unit and a part of the peg extends laterally from the receiving groove of the adjacent elastic module unit.

19. The elastic pad of claim 11, wherein the rotary detent member is configured to releasably hook a corresponding connection rope on the pad layer.

20. The elastic pad of claim 19, wherein the rotary detent member comprises a detent hook and a peg, the detent hook is configured to be releasably snapped into the engagement member of an adjacent elastic module unit; the rotary detent member is configured to shift between a storage position where the detent hook releasably hooks a corresponding connection rope, and an engagement position where the peg releasably hooks the corresponding connection rope.

21. The elastic pad of claim 11, wherein the rotary detent member is configured to releasably hook a corresponding connection rope on the cover.

22. The elastic pad of claim 11, wherein each of the splicing sides is formed with a pre-positioning structure configured to engage with a pre-positioning structure formed on a splicing side of a fixed bottom plate of an adjacent elastic module unit.

23. The elastic pad of claim 22, wherein the pre-positioning structure comprises a first pre-positioning structure and a second pre-positioning structure arranged at an interval in an extension direction of the splicing sides, the second pre-positioning structure different from the first pre-positioning structure, wherein the first pre-positioning structure is configured to engage with the second pre-positioning structure of an adjacent elastic module unit, and the second pre-positioning structure is configured to engage with the first pre-positioning structure of an adjacent elastic module unit.

24. The elastic pad of claim 23, wherein the first pre-positioning structure located on one side of the elastic module unit is aligned with the second pre-positioning structure located on the other side of the elastic module unit along the transverse direction of the elastic module unit, and the second pre-positioning structure located on the one side of the elastic module unit is aligned with the first pre-positioning structure located on the other side of the elastic module unit along the transverse direction of the elastic module unit.

25. The elastic pad of claim 24, wherein the first pre-positioning structure is formed as a pre-positioning bump, and the second pre-positioning structure is formed as a pre-positioning groove.

26. The elastic pad of claim 7, wherein the elastic pad is used as an elastic mattress.

27. Furniture comprising the elastic pad of claim 7.

* * * * *